US009214145B2

(12) United States Patent
Nakagawa et al.

(10) Patent No.: US 9,214,145 B2
(45) Date of Patent: Dec. 15, 2015

(54) ELECTRONIC MUSICAL INSTRUMENT TO GENERATE MUSICAL TONES TO IMITATE A STRINGED INSTRUMENT

(75) Inventors: Mizuki Nakagawa, Hamamatsu (JP); Ikuo Tanaka, Hamamatsu (JP); Shun Takai, Haamatsu (JP)

(73) Assignee: ROLAND CORPORATION, Hamamatsu (JP)

( * ) Notice: Subject to any disclaimer, the term of this patent is extended or adjusted under 35 U.S.C. 154(b) by 290 days.

(21) Appl. No.: 13/403,351

(22) Filed: Feb. 23, 2012

(65) Prior Publication Data

US 2012/0227576 A1 Sep. 13, 2012

(30) Foreign Application Priority Data

Mar. 11, 2011 (JP) ..... 2011-054690

(51) Int. Cl.
*G10H 1/36* (2006.01)
*G10H 1/22* (2006.01)

(52) U.S. Cl.
CPC ..... *G10H 1/22* (2013.01); *G10H 2250/441* (2013.01)

(58) Field of Classification Search
USPC ..... 84/615
See application file for complete search history.

(56) References Cited

U.S. PATENT DOCUMENTS 4,237,764 A * 12/1980 Suzuki ..... 84/704
2010/0077907 A1* 4/2010 Tanaka et al. ..... 84/604

FOREIGN PATENT DOCUMENTS

| | | |
|---|---|---|
| JP | 4097294 | 3/1992 |
| JP | 7020865 | 1/1995 |
| JP | 11024665 | 1/1999 |
| JP | 200510438 | 1/2005 |
| JP | 2009037022 | 2/2009 |
| JP | 2009058558 | 3/2009 |
| JP | 201079178 | 4/2010 |

OTHER PUBLICATIONS

English machine translation of JP11024665 published Jan. 29, 1999 by Korg KK.
English Abstract and Machine Translation for JP200510438, published on Jan. 13, 2005, Total 20 pp.
(Continued)

*Primary Examiner* — Christopher Uhlir
(74) *Attorney, Agent, or Firm* — David W. Victor; Konrad Raynes Davda & Victor LLP

(57) ABSTRACT

Provided are an electronic musical instrument, computer storage device, and method for generating tone. A sound source in an electronic musical instrument generates a first tone at a first pitch in response to a first tone generation instruction received by an input device of the electronic musical instrument. A second tone generation instruction is received to generate a second tone at a second pitch while generating the first tone at the sound source. A determination is made of a pitch difference of the first and the second pitches. The sound source is controlled to generate the second tone and to not generate the first tone in response to determining that the pitch difference does not exceed a predetermined number of tones. The sound source is controlled to generate the second tone in response to determining that the pitch difference exceeds the predetermined number of tones.

26 Claims, 6 Drawing Sheets

(56) References Cited

OTHER PUBLICATIONS

English Abstract and Machine Translation for JP201079178, published on Apr. 8, 2010, Total 32 pp.
English Abstract and Machine Translation for JP2009037022, published on Feb. 19, 2009, Total 26 pp.
English Abstract and Machine Translation for JP2009058558, published on Mar. 19, 2009, Total 23 pp.
Japanese Office Action 1, Aug. 11, 2015, for JP2011054690, Total 4 pp.
Machine Translation of Japanese Office Action 1, Aug. 11, 2015, for JP2011054690, Total 3 pp.
English Abstract and Machine Translation for JP7020865, published on Jan. 24, 1995, Total 28 pp.
English Abstract for JP4097294, published on Mar. 30, 1992, Total 1 p.

* cited by examiner

ELECTRONIC MUSICAL INSTRUMENT TO GENERATE MUSICAL TONES TO IMITATE A STRINGED INSTRUMENT

CROSS-REFERENCE TO RELATED FOREIGN APPLICATION

This application is a non-provisional application that claims priority benefits under Title 35, United States Code, Section 119(a)-(d) from Japanese Patent Application entitled "ELECTRONIC MUSICAL INSTRUMENT" by Mizuki NAKAGAWA, Ikuo TANAKA, and Shun TAKAI, having Japanese Patent Application Serial No. 2011-054690, filed on Mar. 11, 2011, which Japanese Patent Application is incorporated herein by reference in its entirety.

BACKGROUND OF THE INVENTION

Electronic musical instruments such as synthesizers and the like can generate tones with various kinds of tone colors. When performance of a natural musical instrument is imitated by an electronic musical instrument, it is necessary to make the tone colors to be faithfully imitated to tone colors of the natural musical instrument. In addition, the performer needs to understand characteristics peculiar to the musical instrument while operating user interfaces of the musical instrument (such as, for example, the keyboard, the pitch-bend lever, the modulation lever, the HOLD pedal and the like) during performance. Therefore, when a performer attempts to imitate performance of a certain musical instrument, using an electronic musical instrument, the performer needs to understand the characteristics of the musical instrument to be imitated and needs high-level skills in performance technique to make full use of the user interfaces to adequately imitate the characteristics of the musical instrument during performance.

When a musical instrument that is capable of generating multiple tones at the same time, such as a guitar, is imitated by keyboard operation on an electronic musical instrument, performance in a poly mode, by which a plurality of tones can be generated at the same time, is desirable. However, for example, a string musical instrument such as a guitar is characterized due to its structure in that, while multiple tones can be generated as described above, a tone that is being generated on one string is silenced when the same string is plucked. Therefore, when a string musical instrument such as a guitar is imitated by keyboard operation of an electronic musical instrument, the performer needs to pay attention to avoid generating multiple tones concurrently that would be on the same string of the instrument being imitated in poly mode, such as a guitar. This requires high-level performance technique.

Japanese Patent No. 3738117 describes a technology to switch between a polyphonic assignment and a monophonic assignment depending on the strength of a key depression.

However, the technology described in Japanese Patent No. 3738117 cannot imitate the characteristic of a string musical instrument such as a guitar.

SUMMARY

Provided are an electronic musical instrument, computer storage device, and method for generating tone. A sound source in an electronic musical instrument generates a first tone at a first pitch in response to a first tone generation instruction received by an input device of the electronic musical instrument. A second tone generation instruction is received to generate a second tone at a second pitch while generating the first tone at the sound source. A determination is made of a pitch difference of the first and the second pitches. The sound source is controlled to generate the second tone and to not generate the first tone in response to determining that the pitch difference does not exceed a predetermined number of tones. The sound source is controlled to generate the second tone in response to determining that the pitch difference exceeds the predetermined number of tones.

DETAILED DESCRIPTION

Figure 1:
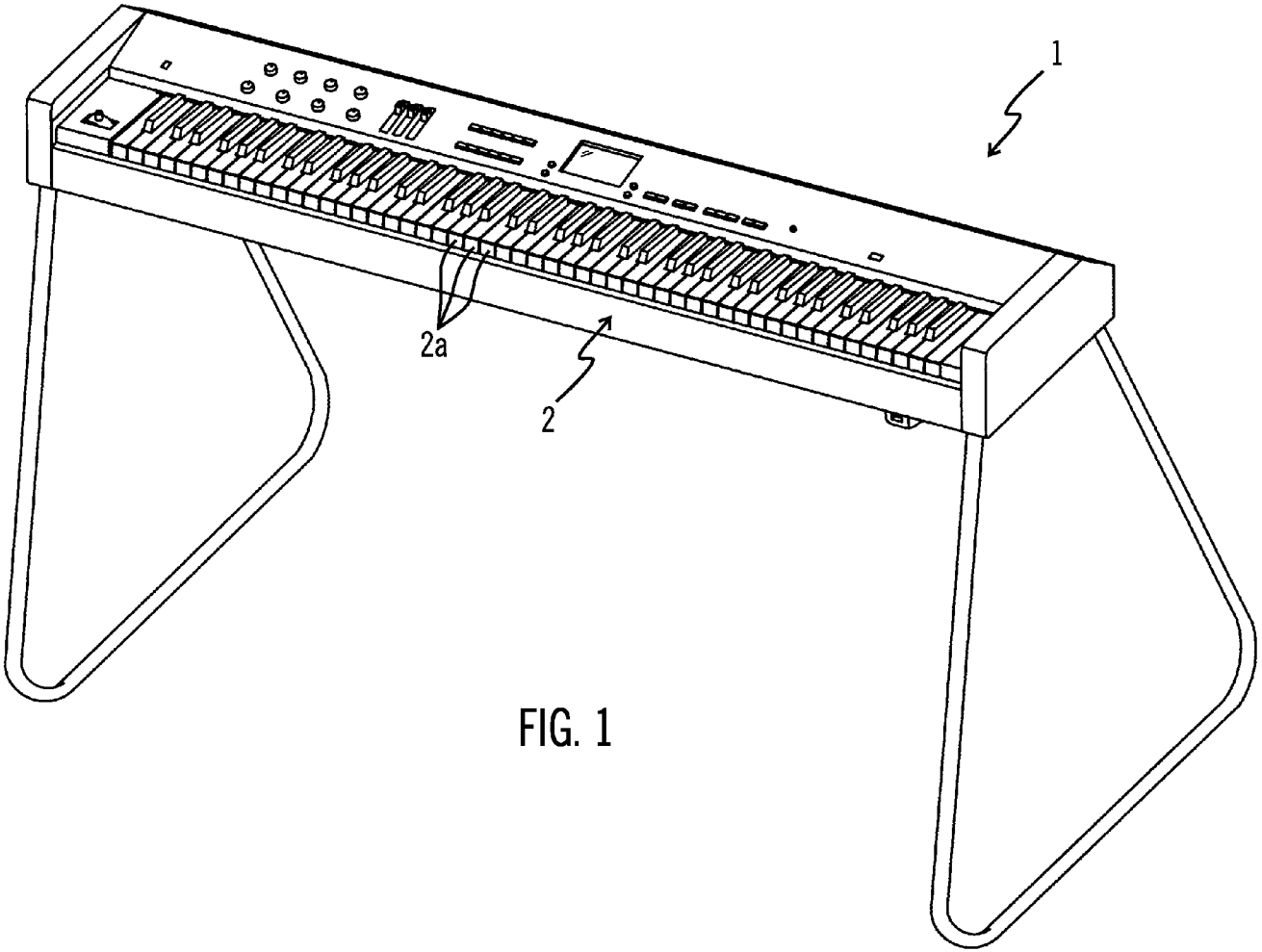
FIG. 1 is an external appearance of an electronic musical instrument in accordance with described embodiments.

Described embodiments provide an electronic musical instrument that automatically generates tones in a mono mode manner which does not generate multiple tones at the same time, even when a poly mode is set, when a predetermined condition is met, and therefore can sufficiently imitate the characteristic of a string musical instrument such as a guitar.

In the described embodiments, in a poly mode (a mode in which multiple tones can be generated at the same time), when a pitch difference obtained by a pitch difference obtaining device equals a predetermined value or less, and a time difference obtained by a time difference obtaining device equals a predetermined time or less, a control device controls tone generation by a tone generation device such that a tone with a pitch corresponding to a previous tone generation instruction is not generated thereafter, and a tone with a pitch corresponding to a current tone generation instruction is generated. In other words, even when a poly mode is set, when the pitch difference and the time difference between two consecutive tone generation instructions (a current tone generation instruction and a previous tone generation instruction) meet a predetermined condition, tone generation is automatically controlled as though it were in a mono mode such that a tone with a pitch corresponding to the previous tone generation instruction is not generated thereafter, and a tone with a pitch corresponding to the current tone generation instruction is generated. Therefore, the performer can achieve performance in a mono mode fashion, even when a poly mode is set, without having to pay attention not to generate multiple tones at the same time.

A string musical instrument such as a guitar is characterized due to its structure in that a tone that is being generated on one string is silenced when the same string is plucked, and the performer who plays such a string musical instrument tends to pluck the same string if a pitch difference equals to a predetermined value or less so as to achieve fast finger movements. Therefore, when the pitch difference between two consecutive tone generation instructions equals a predetermined value or less, and the time difference between them equals a predetermined time or less, tone generation is controlled thereafter in a manner that a tone with a pitch corresponding to the previous tone generation instruction (the tone generation instruction made last time) is not generated, and a tone with a pitch corresponding to the current tone generation instruction (the tone generation instruction made this time) is generated. In this way, a string musical instrument such as a guitar having the structural characteristic and the performer's tendency described above can be faithfully imitated. In certain described embodiments, the performer can achieve performance in a mono mode fashion that imitates performance of a string musical instrument such as a guitar, even when a poly mode is set, without having to pay attention not to generate multiple tones at the same time.

In a further embodiment, in a poly mode, when the pitch difference obtained by the pitch difference obtaining device equals the predetermined value or less, and the time difference obtained by the time difference obtaining device equals the predetermined time or less, the control device controls such that a tone being generated based on the previous tone generation instruction is silenced, and a tone with a pitch corresponding to the current tone generation instruction is generated. Therefore, when the pitch difference between two consecutive tone generation instructions equals the predetermined value or less, and the time difference between them equals the predetermined time or less, a tone that is being generated based on the previous tone generation instruction is silenced, and a tone based on the current tone generation instruction is generated, which is effective in that the characteristic of a string musical instrument such as a guitar can be readily and sufficiently imitated.

In a further embodiment, in a poly mode, when the pitch difference obtained by the pitch difference obtaining device equals the predetermined value or less, and the time difference obtained by the time difference obtaining device equals to the predetermined time or less, then the control device controls such that the pitch of a tone being generated based on the previous tone generation instruction is changed to a pitch based on the current tone generation instruction. Therefore, when the pitch difference between two consecutive tone generation instructions equals the predetermined value or less, and the time difference between them equals to the predetermined time or less, the second tone among the two tones generated based on the two consecutive tone generation instructions is generated as a tone with a weaker attack. Therefore, a performance in which the attack of the second sound becomes weaker compared to the previous sound provides for imitation of slide performance on a guitar.

In a further embodiment, in a poly mode, the predetermined time is a first predetermined time. When the pitch difference obtained by the pitch difference obtaining device equals the predetermined value or less, and the time difference obtained by the time difference obtaining device equals a second predetermined time or less that is shorter than the first predetermined time, the control device controls such that the pitch of a tone being generated based on the previous tone generation instruction is changed to a pitch based on the current tone generation instruction. Therefore, when the pitch difference between two consecutive tone generation instructions equals the predetermined value or less, and the time difference between them equals the second predetermined time or less, the second tone among the two tones generated based on the two consecutive tone generation instructions is generated as a tone with a weaker attack. Therefore, a performance in which the attack of the second tone becomes weaker compared to the previous sound, imitates a slide performance on a guitar.

In a further embodiment, in a poly mode, when the pitch difference obtained by the pitch difference obtaining device equals the predetermined value or less, and the time difference obtained by the time difference obtaining device equals the predetermined time or less but not equal to the second predetermined time or less, the control device controls such that a tone being generated based on the previous tone generation instruction is silenced, and a tone based on the current tone generation instruction is generated. In this way, the electronic musical instrument imitates the characteristic of a string musical instrument such as a guitar having the structural characteristic in which a tone being generated on one string is silenced when the same string is plucked as a result of the performer's tendency to pluck the same string when a pitch difference equals to a predetermined value or less. Also, various performance techniques that can be executed on the imitated musical instrument can be realized by performing different types of control depending on the time difference between two consecutive tone generation instructions, such that the characteristic of a musical instrument to be imitated can be more faithfully reflected during performance.

Embodiments of the invention are described with reference to the accompanying drawings. FIG. 1 is an external appearance of an electronic musical instrument 1 in accordance with an embodiment of the invention. As shown in FIG. 1, the electronic musical instrument 1 is an electronic keyboard musical instrument having a keyboard 2 composed of a plurality of keys 2*a*. A performer can play a performance piece by depressing or releasing the keys 2*a* of the keyboard 2 of the electronic musical instrument 1.

The keyboard 2 is one of the user interfaces operated by the performer, and outputs to a CPU 11 (see FIG. 2) note events that are pieces of performance information according to the MIDI (Musical Instrument Digital Interface) standard in response to key-depression and key-release operations on the keys 2*a* by the performer. More specifically, when the key 2*a* is depressed by the performer, the keyboard 2 outputs to the CPU 11 a note-on event (hereafter referred to as a "note-on") that is a piece of performance information indicating that the key 2*a* is depressed. On the other hand, when the key 2*a* that has been depressed by the performer is released, the keyboard 2 outputs to the CPU 11 a note-off event (hereafter referred to as a "note-off") that is a piece of performance information indicating that the depressed key 2*a* is released.

In certain embodiments, the electronic musical instrument 1 is configured such that, even when a poly mode (a mode that is capable of generating multiple tones at the same time) is set, if a key close in pitch to a key that was depressed last time is key-depressed at a short key-depression interval since the last key-depression, a tone based on the last key-depression is forcefully silenced, thereby preventing generation of multiple tones at the same time, in other words, tone generation in a mono mode fashion is executed.

Figure 2:
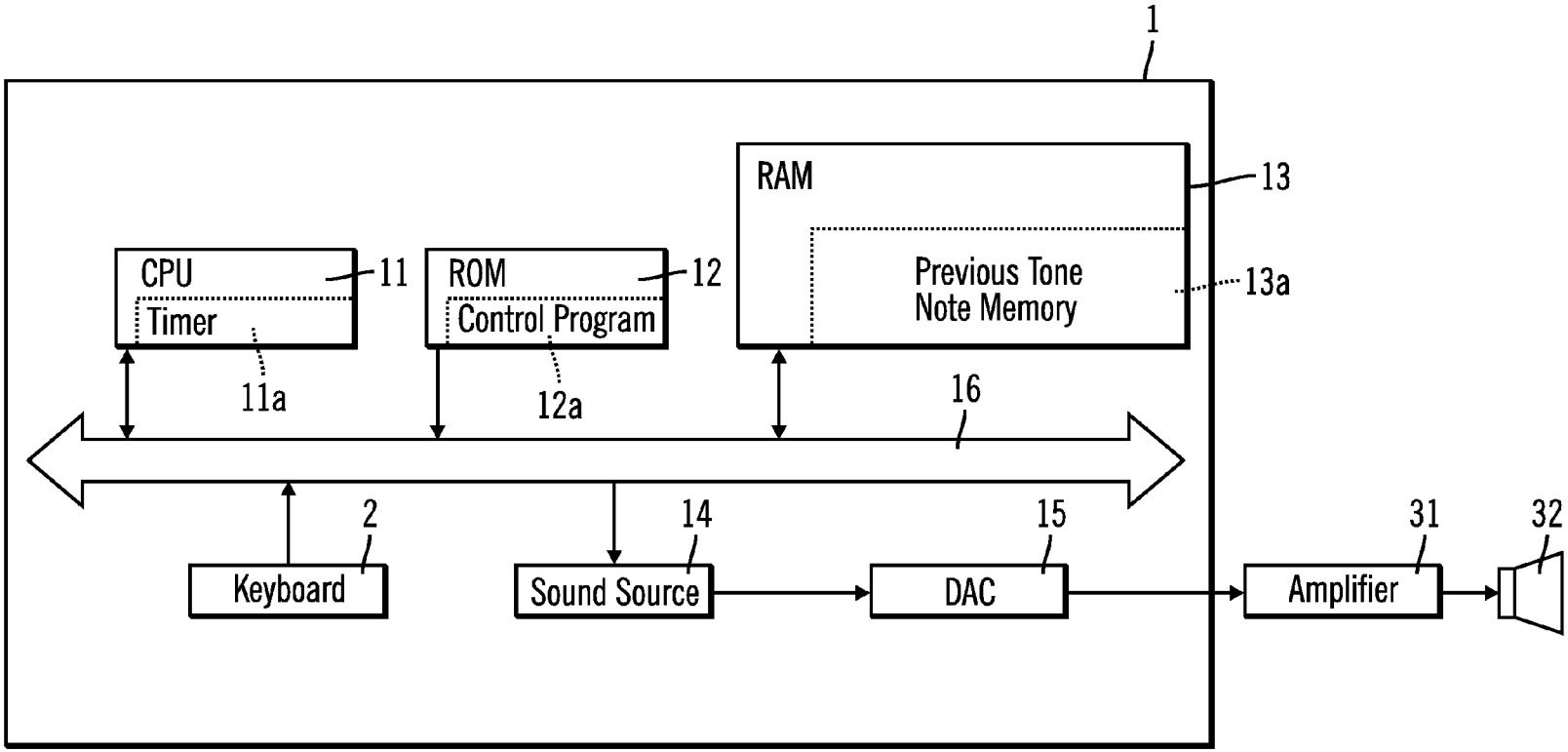
FIG. 2 is a block diagram of an electrical composition of the electronic musical instrument in accordance with described embodiments.

FIG. 2 is a block diagram showing an electrical composition of the electronic musical instrument 1. As shown in FIG. 2, the electronic musical instrument 1 includes a CPU 11, a ROM 12, a RAM 13, and a sound source 14; and the components 11-14 and the keyboard 2 are mutually connected through a bus line 16. The electronic musical instrument 1 also includes a digital-to-analog converter (DAC) 15. The DAC 15 is connected to the sound source 14, and is also connected to an amplifier 31 that is provided outside the electronic musical instrument 1.

The CPU 11 is a central control unit that controls each of the components of the electronic musical instrument 1 according to fixed value data and a control program 12*a* stored in the ROM 12 and the RAM 13. The CPU 11 includes a built-in timer 11*a* that counts clock signals, thereby measuring the time.

Upon receiving a note-on (a piece of performance information indicating that one of the keys 2*a* is depressed) from the keyboard 2, the CPU 11 outputs a tone generation instruction to the sound source 14, thereby rendering the sound source 14 to start generation of a tone (an audio signal) according to the note-on. Also, upon receiving a note-off (a piece of performance information indicating that one of the keys 2*a* having been depressed is released) from the keyboard 2, the CPU 11 outputs a silencing instruction to the sound source 14, thereby performing a silencing control. By this, the tone that is being generated by the sound source 14 is stopped.

Figure 3:
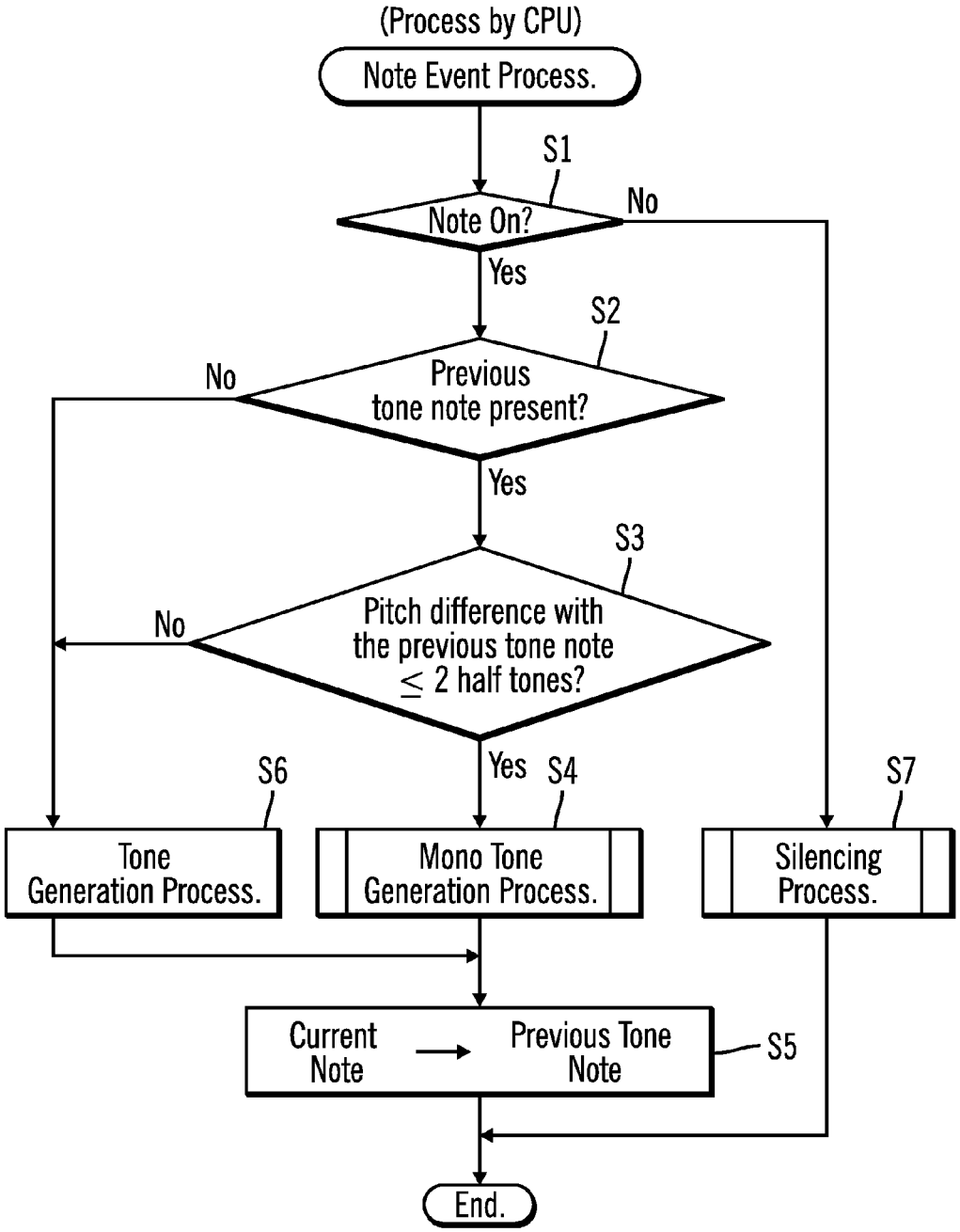
FIG. 3 is a flow chart showing a note event process executed by a CPU of the electronic musical instrument in accordance with described embodiments.
Figure 4:
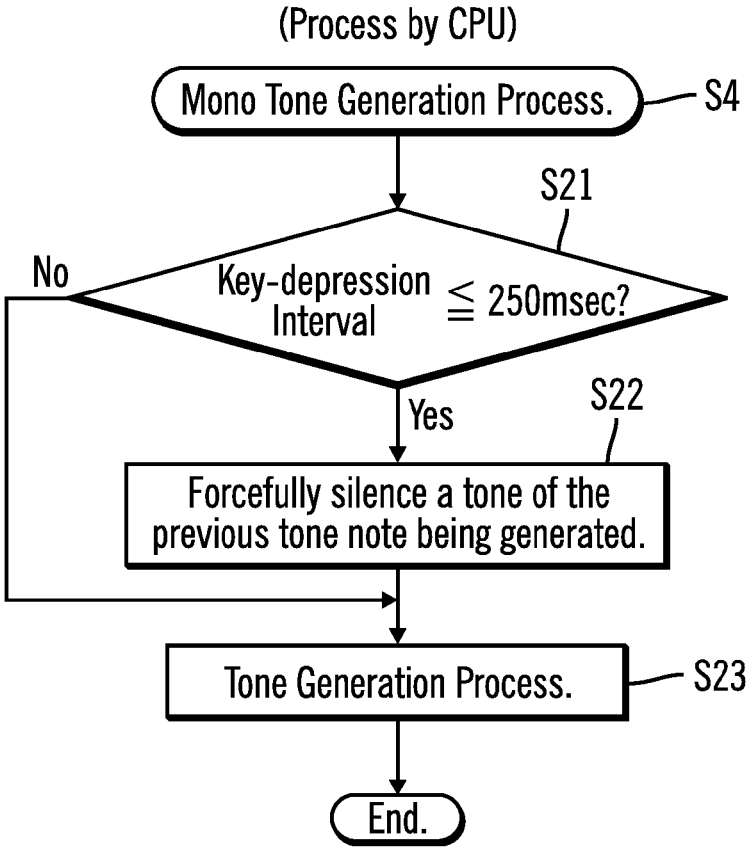
FIG. 4 is a flow chart showing a mono tone generation process executed in the note event process shown in FIG. 3 in accordance with described embodiments.
Figure 5:
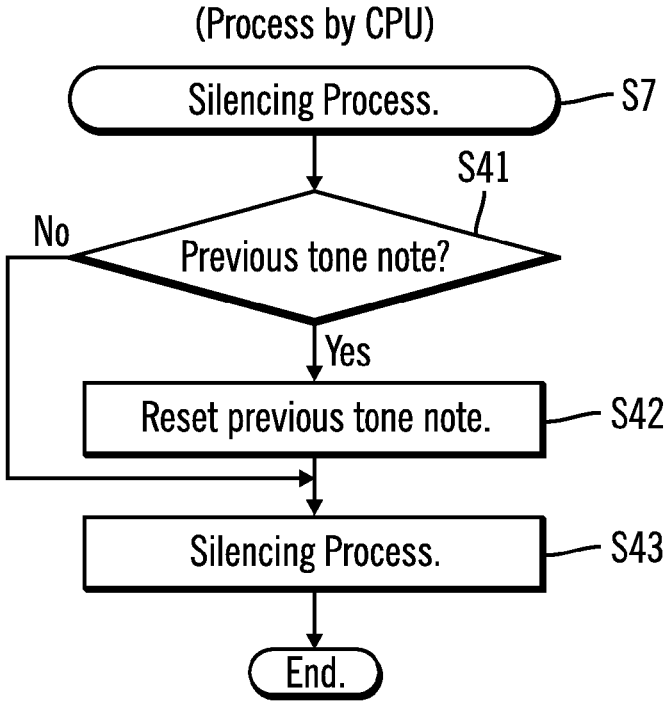
FIG. 5 is a flow chart showing a tone silencing process executed in the note event process shown in FIG. 3 in accordance with described embodiments.

The ROM 12 is a non-rewritable memory, and stores a control program 12*a* to be executed by the CPU 11, fixed value data (not shown) to be referred to by the CPU 11 when the control program 12*a* is executed, and the like. It is noted that each of the processes shown in the flow charts in FIG. 3 through FIG. 5 are executed by the control program 12*a*.

The RAM 13 is a rewritable memory, and has a temporary storage area for temporarily storing various kinds of data for the CPU 11 to execute the control program 12*a*. The temporary area of the RAM 13 is provided with a previous tone note memory 13*a*.

The previous tone note memory 13*a* is a memory that stores, upon depression of the key 2*a*, information of a note being generated based on the previous key-depression (hereafter, this note is referred to as a "previous tone note"). The previous tone note memory 13*a* is initialized (zeroed) when the electronic musical instrument 1 is powered on. Each time any one of the keys 2*a* is depressed by the performer, the CPU 11 receives a note-on from the keyboard 2, and a note (a note number) indicated by the note-on received, and a key-depression time measured by the timer 11*a* are stored in the previous tone note memory 13*a* as information of a previous tone note. The previous tone note information stored in the previous tone note memory 13*a* is zeroed when the corresponding key 2*a* is key-released.

Also, the temporary area of the RAM 13 is provided with a note-on map (not shown). The note-on map is a map that indicates as to whether or not a tone corresponding to each of the keys 2*a* is being generated. More specifically, the note-on map is composed of tone generation flags associated with notes (note numbers) corresponding to the keys 2*a*, respectively. When a tone generation instruction is outputted to the sound source 14, a tone generation flag of a note corresponding to the tone generation instruction is set to ON. On the other hand, when a silencing instruction is outputted to the sound source 14, a tone generation flag of a note corresponding to the silencing instruction is set to OFF.

The sound source 14 generates tones with a tone color set by the performer at pitches corresponding to those of the keys 2*a* depressed or stops tones that are being generated, based on tone generation instructions or silencing instructions received from the CPU 11, respectively. Upon receiving a tone generation instruction from the CPU 11, the sound source 14 generates a tone (an audio signal) with a pitch, a sound volume and a tone color according to the tone generation instruction, adds an envelope waveform to the generated tone according to a setting, and outputs the tone. The tone outputted from the sound source 14 is supplied to the DAC 16 and converted to an analog signal, and outputted through an amplifier 31 from a speaker 32. On the other hand, upon receiving a silencing instruction from the CPU 11, the sound source 14 stops a tone that is being generated according to the silencing instruction. Accordingly, the tone that is being outputted from the speaker 32 is silenced.

FIG. 3 through FIG. 5 describe embodiments of the process executed by the CPU 11 of the electronic musical instrument 1 having the configuration described above. FIG. 3 is a flow chart of a note event process executed by the CPU 11. The note event process is executed each time the CPU 11 receives a note event (a note-on or a note-off) from the keyboard 2, when the mode is set to a poly mode.

In accordance with described embodiments, a poly mode or a mono mode (a mode that cannot generate multiple tones at the same time) is set for each tone color. When a tone color in a poly mode is set, its mode is set in a poly mode. Instead, an operation element such as a switch may be provided on an operation panel (not shown), and the operation element may be operated to set a poly mode or a mono mode.

As shown in FIG. 3, in the note event process, first, it is judged as to whether or not a note event received from the keyboard 2 is a note-on (S1). When it is judged in S1 that the note event received is a note-on (S1: Yes), the previous tone note memory 13*a* is looked up to judge as to whether or not there are any previous tone notes (S2).

When no information of previous tone notes is stored in the previous tone note memory 13*a*, and therefore it is judged in S2 that no previous tone note is present (S2: No), the note event indicates the first key-depression (note-on) from the completely key-released state, and therefore a tone generation process is executed according to the note-on received from the keyboard 2 (S6). In other words, a tone generation instruction according to the received note-on is outputted to the sound source 14, thereby generating a tone corresponding to the note corresponding to the latest key-depression (the current note).

After the step in S6, the content of the previous tone note memory 13*a* is rewritten with the note number of the current note and its key-depression time to set the current note as the previous tone note (S5), and the note event process is ended.

On the other hand, when information of a previous tone note is stored in the previous tone note memory 13*a*, and it is judged in S2 that the previous tone note is present (S2: Yes), the note number of the current note and the note number included in the previous tone note information are compared, and whether or not the pitch difference between the current note and the previous tone note equals to two half tones or less (S3).

When it is judged in S3 that the pitch difference between the current note and the previous tone note exceeds two half tones (S3: No), the process proceeds to S6, and a tone generation process for rendering the sound source 14 to generate a tone corresponding to the current note is executed (S6). After the step in S6, the current note is set as the previous tone note (S5), and the note event process is ended.

On the other hand, when it is judged in S3 that the pitch difference between the current note and the previous tone note equals to two half tones or less (S3: Yes), a mono tone generation process that performs tone generation in a mono mode fashion when the key depression interval between the current note and the previous tone note is short (S4). The mono tone generation process (S4) is described with reference to FIG. 4. After execution of the mono tone generation process (S4), the current note is set as the previous tone note (S5), and the note event process is ended.

Also, when it is judged in S1 that the received note event is a note-off (S1: No), a silencing process according to the received note-off is executed (S7). More specifically, a silencing instruction according to the note-off received is outputted to the sound source 14, thereby silencing the tone corresponding to the note of the key that has been key-released. The silencing process (S7) is described below with reference to FIG. 5. After execution of the silencing process (S7), the note event process is ended.

With respect to FIG. 4, the mono tone generation process (S4) mentioned above will be described. FIG. 4 is a flow chart showing the mono tone generation process (S4) executed in the note event process (see FIG. 3).

In the mono tone generation process (S4), first, based on the key-depression time of the current note measured by the timer 11*a* and the key-depression time of the previous tone note stored in the previous tone note memory 13*a*, it is judged as to whether or not the key-depression interval between the current note and the previous tone note equals 250 milliseconds (msec) or less (S21).

When it is judged in S21 that the key-depression interval between the current note and the previous tone note exceeds 250 msec (S21: No), a tone generation process for the current note is executed (S23). In other words, a tone generation instruction corresponding to the note-on of the current note is outputted to the sound source 14, thereby generating a tone corresponding to the current note. After execution of the tone generation processing (S23), the mono tone generation process (S4) is ended.

On the other hand, when it is judged in S21 that the key-depression interval between the current note and the previous tone note equals 250 msec or less (S21: Yes), a silencing instruction for the previous tone note that is being generated is outputted to the sound source 14, thereby forcefully silencing the tone corresponding to the previous tone note being generated (S22). After the processing in S22, the process proceeds to S23 where a tone generation process is executed for the current note (S23), and then the mono tone generation process (S4) is ended.

According to the mono tone generation process (S4) described above, when the pitch difference between the current note and the previous tone note equals two half tones or less, and the key depression interval between them equals 250 msec or less, the processing in S22 is executed wherein the tone corresponding to the previous tone note is forcefully silenced, such that the tone corresponding to the current note only is generated. In other words, tone generation in a mono mode fashion is performed.

The silencing process (S7) mentioned above will be described with reference to FIG. 5. FIG. 5 is a flow chart showing the silencing process (S7) executed in the note event process (see FIG. 3).

In the silencing process (S7), first, based on the received note-off, it is judged as to whether or not the key 2*a* that has been key-released is a note corresponding to the information of the previous tone note stored in the previous tone note memory 13*a* (in other words, the previous tone note) (S41). When it is judged in S41 that the key-released key 2*a* is not the previous tone note (S41: No), the process proceeds to S43 where a silencing processing is executed (S43). In other words, a silencing instruction according to the received note-off is outputted to the sound source 14, whereby the tone corresponding to the note that has been key-released is silenced. After the silencing processing (S43), the silencing process (S7) is ended.

On the other hand, when it is judged in S41 that the key-depressed key 2*a* is the previous tone note (S41: Yes), the previous tone note memory 13*a* is zeroed, thereby resetting the previous tone note (S42). After the processing in S42, the silencing processing (S43) is executed, and then the silencing process (S7) is ended.

According to the electronic musical instrument 1 of described embodiments, when the condition in which the pitch difference between the current note and the previous tone note equals two half tones or less, and the key depression interval between them equals 250 msec or less, then the tone corresponding to the previous tone note is forcefully silenced, such that the previous tone note and the current note are not generated at the same time, and the tone corresponding to the current note only is generated. In other words, even when a poly mode is set, tone generation in a mono mode fashion is performed when the pitch difference and the key-depression interval between two consecutive tones meet the condition described above. Therefore, the performer can readily imitate performance of a string musical instrument such as a guitar, even when a poly mode is set, without having to pay attention to avoid generating multiple tones at the same time.

The performer who plays a string musical instrument such as a guitar tends to pluck those of the strings as close as possible to each other so as to achieve faster finger movements, and this tendency becomes more prominent as the pitch difference between consecutive tones becomes smaller. In addition, a string musical instrument such as a guitar has the characteristic due to its structure that a tone being generated on one string is silenced when the same string is plucked. Therefore, when tones with a small pitch difference are continued at a short operation interval (key-depression interval), the tone corresponding to the previous tone note (in other words, the key that has been depressed last time) is forcefully silenced, whereby the structural characteristic and the performer's tendency described above can be faithfully imitated.

Therefore, according to the electronic musical instrument 1 of described embodiments, even when performance of a musical instrument that needs to be set in a poly mode, such as a guitar, is imitated, if the current note meets the condition described above based on the pitch difference and the key-depression interval with respect to the previous tone note, tone generation in a mono mode fashion is automatically performed, and therefore the performer can readily realize performance that sufficiently reflects the characteristic of a musical instrument to be imitated, such as, a guitar.

A second embodiment will be described with reference to FIG. 6. The first embodiment described above is configured such that, when the pitch difference between a current note and a previous tone note equals two half tones or less, and the key depression interval between them equals 250 msec or less, a tone corresponding to the previous tone note is forcefully silenced. In contrast, in accordance with the second embodiment, when the pitch difference equals two half notes or less, and the key depression interval is much shorter and equals 150 msec or less, the tone generation process for a tone corresponding to the current note is not executed (in other words, a tone generation instruction for the current note is not outputted to the sound source 14), but the pitch of a tone corresponding to the previous tone note is changed to the pitch of the current note. In the second embodiment, sections identical with those of the first embodiment described above will be appended with the same references, and their description will be omitted.

Figure 6:
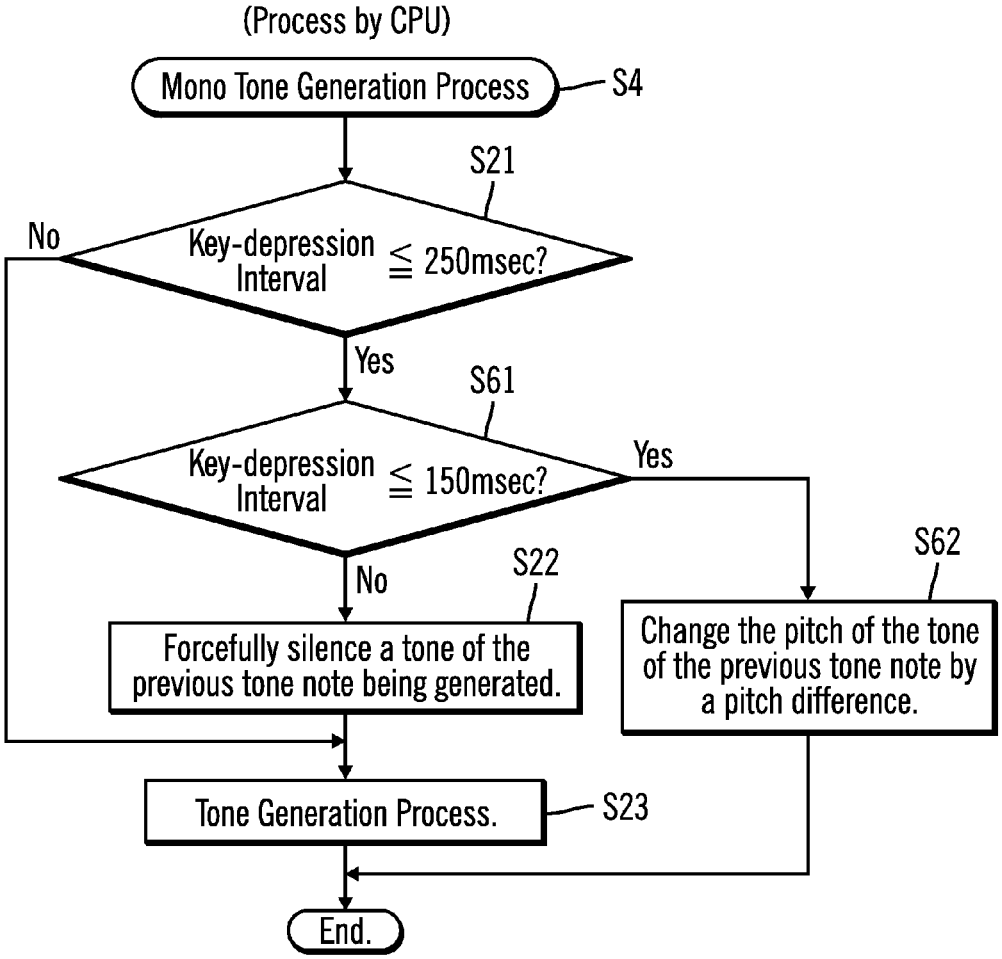
FIG. 6 is a flow chart showing a mono tone generation process in accordance with described embodiments.

FIG. 6 is a flow chart showing the mono tone generation process (S4) in accordance with the second embodiment. The mono tone generation process (S4) shown in FIG. 6 is also executed when it is judged, in S3 in the note event process (see FIG. 3), that the pitch difference between a current note and a previous tone note is two half tones or less (S3: Yes), like the mono tone generation process of the first embodiment shown in FIG. 4. The mono tone generation process (S4) in accordance with the second embodiment is also a process executed by a control program 12*a*.

In the mono tone generation process (S4) in accordance with the second embodiment, first, it is judged as to whether or not the key-depression interval between the current note and the previous tone note equals 250 msec or less (S21). When it is judged that the key-depression interval between the current note and the previous tone note exceeds 250 msec (S21: No), a tone generation process for the current note is executed (S23). After the processing in S23, the mono tone generation process (S4) is ended.

On the other hand, when it is judged that the key-depression interval between the current note and the previous tone note equals 250 msec or less (S21: Yes), it is judged as to whether or not the key-depression interval between the current note and the previous tone note equals to 150 msec or less, which is shorter than 250 msec (S61).

When it is judged in S61 that the key-depression interval between the current note and the previous tone note exceeds 150 msec (S61: No), the process proceeds to S22 where the tone corresponding to the previous tone note that is being generated is forcefully silenced (S22), like the first embodiment. Then, a tone generation process for the current note is executed (S23), and the mono tone generation process (S4) is ended.

On the other hand, when it is judged in S61 that the key-depression interval between the current note and the previous tone note equals to 150 msec or less (S61: Yes), the pitch of the tone corresponding to the previous tone note is changed by the pitch difference between the current note and the previous tone note (S62). In other words, an output of a tone generation instruction for the current note is prohibited, thereby prohibiting the sound source 14 from generating a tone corresponding to the current note, and an instruction to change the pitch of the tone corresponding to the previous tone note by the pitch difference with respect to the current noted is outputted to the sound source 14, thereby rendering the sound source 14 to keep generating the tone corresponding to the previous tone note and changing the pitch of the tone to the pitch of the current note. After the processing in S62, the mono tone generation process (S4) is ended.

According to the mono tone generation process (S4) in accordance with the second embodiment described above, when the pitch difference between the current note and the previous tone note equals two half tones or less, and the key depression interval between them is longer than 150 msec and equals 250 msec or less, then the tone corresponding to the previous tone note is forcefully silenced, such that the tone corresponding to the current note only is generated, like the first embodiment. On the other hand, when the pitch difference between the current note and the previous tone note equals two half tones or less, and the key depression interval between them equals 150 msec or less, a tone corresponding to the current note is not newly generated by the sound source 14, but the pitch of the tone corresponding to the previous tone note is changed to the pitch of the current note.

Figure 7:
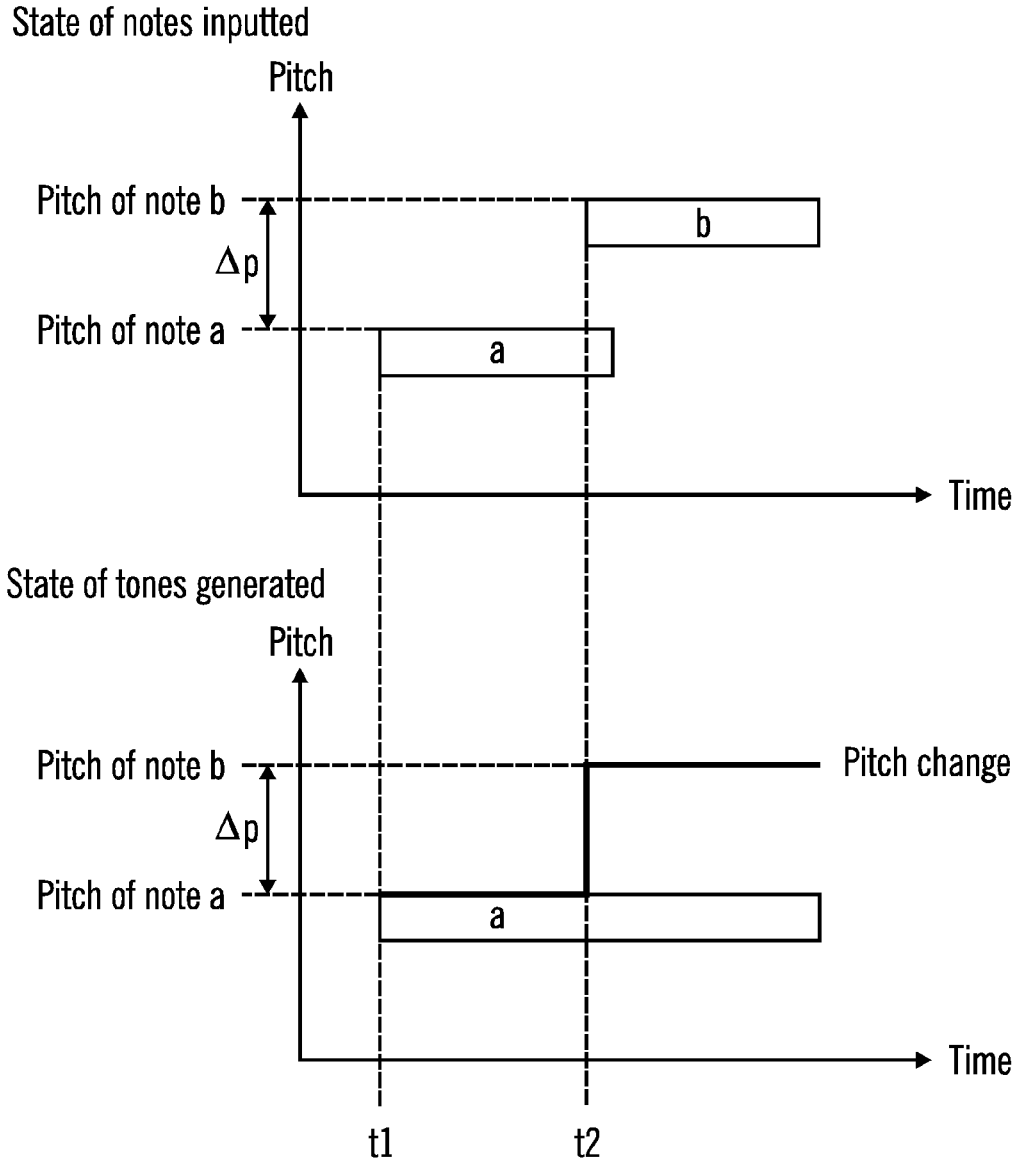
FIG. 7 is a diagram for explaining the state of notes inputted through key-depression of keys by the performer, and the state of actual tones generated in accordance with described embodiments.

FIG. 7 illustrates and describes the state in which the processing in S62 is executed in the mono tone generation process in accordance with the second embodiment described above (see FIG. 6). FIG. 7 is a diagram for explaining the state of notes inputted through key-depression of the keys 2*a* by the performer, and the state of actual tone generated.

In FIG. 7, the upper side shows a graph showing the time-sequence of the states of notes inputted through key-depression operation by the performer, and the lower side shows a graph showing the time-sequence of the states of actually generated tones corresponding to the state of notes indicated in the graph on the upper side. Both of the graphs plot the pitch along the vertical axis and time along the horizontal axis.

As shown in the graph on the upper side, when the performer inputs a note a at time t1, the sound source 14 starts generating a tone corresponding to the note a, as indicated in the graph on the lower side. At this moment, the pitch of the tone to be generated is the pitch of the note a.

Thereafter, as shown in the graph on the upper side, a note b is inputted at time t2. In this case, when the pitch difference Δp between the note a and the note b equals two half tones or less, and the key-depression interval (time t2−time t1) equals 150 msec or less, the processing in S62 is executed in the mono tone generation process shown in FIG. 6. By the processing in S62, the CPU 11 does not output a tone generation instruction for the note b that is the current note, and outputs, to the sound source 14, an instruction to change the pitch of the tone corresponding to the note a that is the previous tone note by the pitch difference Δp.

Therefore, the sound source 14 does not generate a tone corresponding to the note b that is the current note, keeps generating the tone corresponding to the note a that is the previous tone note, and changes the pitch of the tone from the pitch of the note a to the pitch of the note b by Δp at time t2 that is the key-depression time of the note b as a boundary, as indicated by a thick solid line in the graph on the lower side. In other words, the sound source 14 does not newly generate a tone corresponding to the note b that is the current note based on a tone generation instruction, but the pitch of the tone corresponding to the note a is changed to generate a tone with the pitch of the note b.

As described above, according to the electronic musical instrument 1 of the second embodiment, when the pitch difference between the current note and the previous tone note equals two half tones or less, and the key-depression interval equals 150 msec or less, the tone corresponding to the note b that is the current note is not generated according to a tone generation instruction by the sound source 14, but is generated by changing the pitch of the tone corresponding to the note a that is the previous tone note. In other words, even when a poly mode is set, when the pitch difference and the key-depression interval between two consecutive tones satisfy the condition described above, these tones are not generated at the same time, and are automatically controlled to be generated in a mono mode fashion. Therefore, the performer can readily imitate performance of a string musical instrument such as a guitar, even when a poly mode is set, without the user having to pay attention to not generate multiple tones at the same time.

Also, the tone corresponding to the note b is not generated according to a tone generation instruction by the sound source 14, but the tone with the pitch corresponding to the note b is generated through changing the pitch of the tone corresponding to the note a that is the previous tone note, such that the tone corresponding to the note b that is the current note can be heard as a tone with a weaker attack. Therefore, according to the electronic musical instrument 1 of the second embodiment, among two tones that continue at a key-depression interval of 150 msec or less, the second tone can be heard as a tone with a weak attack to imitate a slide technique and hammer-on technique in which the attack of a second tone becomes weaker with respect to a previous tone.

On the other hand, when the pitch difference between the current note and the previous tone note equals two half tones or less, and the key depression interval between them is longer than 150 msec but equals 250 msec or less, tone generation in a mono mode fashion is performed, through forcefully silencing the tone corresponding to the previous tone note, without a change in the pitch of the previous tone note. In other words, in accordance with the electronic musical instrument 1 of the second embodiment, the processing for performing tone generation in a mono mode fashion is varied depending on the key-depression interval. For example, there may be various situations when the performer plays the same string. For example, the fingers may be simply moved to play the same strings again, or may be slid on the same strings while being pressed down (in other words, a slide is performed), and the like. Therefore, various kinds of performance techniques that can be executed on a musical instrument being imitated can be realized through performing different operations based on key-depression intervals.

Also, according to the electronic musical instrument 1 of the second embodiment, as shown in FIG. 7, the pitch of the note a that is the previous tone note is changed from the pitch of the note a to the pitch of the note b in a stepwise fashion at the time t2 that is the key-depression timing of the note b as a boundary. In the case of a string musical instrument provided with frets, such as, a guitar, when the finger is slid on a string while been pressed down, the pitch changes at each of the frets in a stepwise fashion. Therefore, as shown in FIG. 7, because the pitch of the note a is changed in a stepwise fashion at the time t2 as a boundary, the characteristic of a string musical instrument provided with frets can be faithfully imitated.

The invention has been described above with respect to certain embodiments. However, the invention is not limited to the embodiments described above, and it is readily presumed that various changes and modifications can be made within the range that does not depart from the subject matter of the invention.

For example, in embodiments described above, the CPU 11 executes the processes shown in FIG. 3 through FIG. 6, whereby tone generation in a mono mode fashion is automatically performed when predetermined conditions are met even in a poly mode. However, processes corresponding to the processes shown in FIG. 3 through FIG. 6 may be executed by the sound source 14.

Also, in embodiments described above, in the step S22 of the mono tone generation process shown in FIG. 4 or FIG. 6, in order to forcefully silence a tone corresponding to the previous tone note being generated, a silencing instruction corresponding to the previous tone note is outputted to the sound source 14. However, not only the silencing instruction, but also release offset information (control number 77) to adjust the release time of the set tone color may be outputted to the sound source 14, thereby momentarily shortening the release time of the tone corresponding to the previous tone note.

Also, in the mono tone generation process in the embodiments described above (see FIG. 4 or FIG. 6), when it is judged in S21 that the key-depression interval between the current note and the previous tone note equals 250 msec or less (S21: Yes), then the tone corresponding to the previous tone note being generated is forcefully silenced (S22), and the tone generation processing corresponding to the current note is executed. Instead, when a judgment Yes is made in S21, the tone generation processing (S23) may be executed first, and then the processing in S22 (the process to forcefully silence the tone corresponding to the previous tone note being generated) may be executed.

Also, in the mono tone generation process of the first embodiment (see FIG. 4), when it is judged in S21 that the key-depression interval between the current note and the previous tone note equals 250 msec or less (S21: Yes), then the processing in S23 is executed, thereby forcefully silencing the tone corresponding to the previous tone note being generated. Instead, when it is judged that the key-depression interval equals 250 msec or less (S21: Yes), the processing in S23 may not be executed, and the process to change the pitch of the tone corresponding to the previous tone note by the pitch difference between the current note and the previous tone note (in other words, the processing in S62 in the second embodiment) may be executed.

Further, in embodiments described above, in the mono tone generation process (in FIG. 4 or FIG. 6), 250 msec and 150 msec are used as threshold values of the key-depression intervals for executing the judging process in S21 and S61. However, these threshold values are not limited to these specific values.

Also, in the second embodiment, in the case of "150 msec<Key-depression Interval≤250 msec" and in the case of "Key-depression Interval<150 msec," different operations are performed for tone generation in a mono mode fashion. However, the range of the key-depression interval may be divided into three or more ranges, and different operations may be performed for the divided ranges, respectively.

Also, in the embodiments described above, the electronic musical instrument 1 is described as constructed in one piece with the keyboard 2. However, an electronic musical instrument in accordance with the invention may be configured as a sound source module that can be detachably connected to a keyboard that outputs note-on and note-off signals like the keyboard 2, a sequencer or the like.

What is claimed is:

1. An electronic musical instrument comprising:

an input device for inputting a tone generation instruction for a tone with a predetermined pitch;

a tone generation device that generates a tone with a predetermined pitch based on a tone generation instruction inputted by the input device to imitate a string instrument;

a pitch difference obtaining device that obtains a pitch difference between a current tone generation instruction and a previous tone generation instruction in response to the tone generation instruction inputted by the input device;

a time difference obtaining device that obtains a time difference between the current tone generation instruction and the previous tone generation instruction in response to the tone generation instruction inputted by the input device; and a control device that operates in a poly mode to generate multiple tones at the same time and that controls the tone generation device to:

not generate a previous tone with a previous pitch corresponding to the previous tone generation instruction and to generate a current tone with a current pitch corresponding to the current tone generation instruction in response to determining that the pitch difference equals a predetermined number of tones or less and that the time difference equals a predetermined time or less, wherein such determinations indicate that the current and previous pitches occur on a same string of the imitated string instrument; and generate the current tone with the current pitch while generating the previous tone with the previous pitch in response to determining one of (1) that the pitch difference exceeds the predetermined number of tones or (2) that the pitch difference does not exceed the predetermined number of tones and that the time difference exceeds the predetermined time.

2. The electronic musical instrument of claim 1, wherein the controlling the tone generation device to not generate the previous tone with the previous pitch and to generate the current tone with the current pitch when operating in the poly mode comprises controlling the tone generation device to silence the previous tone being generated and to generate the current tone.

3. The electronic musical instrument of claim 1, wherein the controlling the tone generation device to not generate the previous tone with the previous pitch and to generate the current tone with the current pitch when operating in the poly mode comprises controlling the tone generation device to change the previous pitch of the previous tone being generated to the current pitch of the current tone.

4. The electronic musical instrument of claim 1, wherein the predetermined time comprises a first predetermined time, and wherein the controlling the tone generation device to not generate the previous tone with the previous pitch and to generate the current tone with the current pitch when operating in the poly mode comprises controlling the tone generation device to change the previous pitch of the previous tone being generated to the current pitch of the current tone in response to determining that the pitch difference equals the predetermined number of tones or less and that the time difference equals a second predetermined time or less, wherein the second predetermined time is less than the first predetermined time.

5. The electronic musical instrument of claim 4, wherein the controlling the tone generation device to not generate the previous tone with the previous pitch and to generate the current tone with the current pitch when operating in the poly mode comprises controlling the tone generation device to silence the previous tone being generated and to generate the current tone in response to determining that the pitch difference equals the predetermined number of tones or less and that the time difference equals the first predetermined time or less and exceeds the second predetermined time.

6. An electronic musical instrument, comprising:

an input device;

a sound source to generate sound imitating a stringed instrument;

a processor; and a computer storage device including a program executed by the processor to perform operations, the operations comprising:

instructing the sound source to generate a first tone at a first pitch to imitate the first pitch on the imitated string instrument in response to a first tone generation instruction received by the input device;

receiving a second tone generation instruction to generate a second tone at a second pitch to imitate the second pitch on the imitated string instrument while generating the first tone at the sound source, wherein the first tone generation instruction was received at a first time and the second tone generation instruction was received at a second time;

controlling the sound source to generate the second tone and to not generate the first tone in response to determining a pitch difference of the first and second pitches does not exceed a predetermined number of tones and an interval comprising a difference of the first time and the second time does not exceed a predetermined time; and controlling the sound source to generate the second tone while generating the first tone in response to determining one of (1) that the pitch difference exceeds the predetermined number of tones or (2) that the pitch difference does not exceed the predetermined number of tones and the interval exceeds the predetermined time.

7. The electronic musical instrument of claim 6, wherein the determining whether the interval comprising the difference of the first time and the second time exceeds the predetermined time is performed in response to determining that the pitch difference does not exceed the predetermined number of tones.

8. The electronic musical instrument of claim 6, wherein the controlling of the sound source to generate the second tone and to not generate the first tone comprises:

outputting a silence instruction to the sound source to silence the first tone; and outputting the second tone generation instruction to the sound source to generate the second tone.

9. The electronic musical instrument of claim 6, wherein the controlling of the sound source to generate the second tone and to not generate the first tone comprises instructing the sound source to change the first pitch of the first tone being generated to the second pitch of the second tone in a stepwise fashion.

10. The electronic musical instrument of claim 6, wherein the determining whether the interval exceeds the predetermined time comprises:

determining whether the interval comprising the difference of the first time and the second time exceeds a first predetermined time in response to determining that the pitch difference does not exceed the predetermined number of tones; and determining whether the interval exceeds a second predetermined time in response to determining that the interval does not exceed the first predetermined time, wherein the second predetermined time is less than the first predetermined time; and wherein the controlling of the sound source to generate the second tone and to not generate the first tone comprises:

performing a first process to control the sound source in response to determining that the interval exceeds the second predetermined time; and performing a second process to control the sound source in response to determining that the interval does not exceed the second predetermined time.

11. The electronic musical instrument of claim 10, wherein the operations further comprise outputting the second tone generation instruction to the sound source to generate the second tone in response to determining that the interval exceeds the first predetermined time.

12. The electronic musical instrument of claim 10, wherein the first process comprises outputting a silence instruction to the sound source to silence the first tone and outputting the second tone generation instruction to the sound source to generate the second tone; and wherein the second process comprises instructing the sound source to change the first pitch of the first tone being generated to the second pitch of the second tone in a stepwise fashion.

13. A computer storage device including a program executed by a processor to perform operations with respect to an electronic musical instrument having an input device and sound source, wherein the operations comprise:

instructing the sound source to generate a first tone at a first pitch to imitate the first pitch on an imitated string instrument in response to a first tone generation instruction received by the input device;

receiving a second tone generation instruction to generate a second tone at a second pitch to imitate the second pitch on the imitated string instrument while generating the first tone at the sound source, wherein the first tone generation instruction was received at a first time and the second tone generation instruction was received at a second time;

controlling the sound source to generate the second tone and to not generate the first tone in response to determining a pitch difference of the first and second pitches does not exceed a predetermined number of tones and an interval comprising a difference of the first time and the second time does not exceed a predetermined time; and controlling the sound source to generate the second tone while generating the first tone in response to determining one of (1) that the pitch difference exceeds the predetermined number of tones or (2) that the pitch difference does not exceed the predetermined number of tones and the interval exceeds the predetermined time.

14. The computer storage device of claim 13, wherein the determining whether the interval comprising the difference of the first time and the second time exceeds the predetermined time is performed in response to determining that the pitch difference does not exceed the predetermined number of tones.

15. The computer storage device of claim 13, wherein the controlling of the sound source to generate the second tone and to not generate the first tone comprises:

outputting a silence instruction to the sound source to silence the first tone; and outputting the second tone generation instruction to the sound source to generate the second tone.

16. The computer storage device of claim 13, wherein the controlling of the sound source to generate the second tone and to not generate the first tone comprises instructing the sound source to change the first pitch of the first tone being generated to the second pitch of the second tone in a stepwise fashion.

17. The computer storage device of claim 13, wherein the determining whether the interval exceeds the predetermined time comprises:

determining whether the interval comprising the difference of the first time and the second time exceeds a first predetermined time in response to determining that the pitch difference does not exceed the predetermined number of tones; and determining whether the interval exceeds a second predetermined time in response to determining that the interval does not exceed the first predetermined time, wherein the second predetermined time is less than the first predetermined time; and wherein the controlling of the sound source to generate the second tone and to not generate the first tone comprises:

performing a first process to control the sound source in response to determining that the interval exceeds the second predetermined time; and performing a second process to control the sound source in response to determining that the interval does not exceed the second predetermined time.

18. The computer storage device of claim 17, wherein the operations further comprise outputting the second tone generation instruction to the sound source to generate the second tone in response to determining that the interval exceeds the first predetermined time.

19. The computer storage device of claim 17, wherein the first process comprises outputting a silence instruction to the sound source to silence the first tone and outputting the second tone generation instruction to the sound source to generate the second tone; and wherein the second process comprises instructing the sound source to change the first pitch of the first tone being generated to the second pitch of the second tone in a stepwise fashion.

20. A method, comprising:

instructing a sound source in an electronic musical instrument to generate a first tone at a first pitch to imitate the first pitch on an imitated string instrument in response to a first tone generation instruction received by an input device of the electronic musical instrument;

receiving a second tone generation instruction to generate a second tone at a second pitch to imitate the second pitch on the imitated string instrument while generating the first tone at the sound source, wherein the first tone generation instruction was received at a first time and the second tone generation instruction was received at a second time;

controlling the sound source to generate the second tone and to not generate the first tone in response to determining that a pitch difference of the first and second pitches does not exceed a predetermined number of tones and an interval comprising a difference of the first time and the second time does not exceed a predetermined time; and controlling the sound source to generate the second tone while generating the first tone in response to determining one of (1) that the pitch difference exceeds the predetermined number of tones or (2) that the pitch difference does not exceed the predetermined number of tones and the interval exceeds the predetermined time.

21. The method of claim 20, wherein the determining whether the interval comprising the difference of the first time and the second time exceeds the predetermined time is performed in response to determining that the pitch difference does not exceed the predetermined number of tones.

22. The method of claim 20, wherein the controlling of the sound source to generate the second tone and to not generate the first tone comprises:

outputting a silence instruction to the sound source to silence the first tone; and outputting the second tone generation instruction to the sound source to generate the second tone.

23. The method of claim 20, wherein the controlling of the sound source to generate the second tone and to not generate the first tone comprises instructing the sound source to change the first pitch of the first tone being generated to the second pitch of the second tone in a stepwise fashion.

24. The method of claim 20, wherein the determining whether the interval exceeds the predetermined time comprises:

determining whether the interval comprising the difference of the first time and the second time exceeds a first predetermined time in response to determining that the pitch difference does not exceed the predetermined number of tones; and determining whether the interval exceeds a second predetermined time in response to determining that the interval does not exceed the first predetermined time, wherein the second predetermined time is less than the first predetermined time; and wherein the controlling of the sound source to generate the second tone and to not generate the first tone comprises:

performing a first process to control the sound source in response to determining that the interval exceeds the second predetermined time; and performing a second process to control the sound source in response to determining that the interval does not exceed the second predetermined time.

25. The method of claim 24, further comprising:

outputting the second tone generation instruction to the sound source to generate the second tone in response to determining that the interval exceeds the first predetermined time.

26. The method of claim 24, wherein the first process comprises outputting a silence instruction to the sound source to silence the first tone and outputting the second tone generation instruction to the sound source to generate the second tone; and wherein the second process comprises instructing the sound source to change the first pitch of the first tone being generated to the second pitch of the second tone in a stepwise fashion.

* * * * *